United States Patent [19]

Anderson et al.

[11] 3,930,679

[45] Jan. 6, 1976

[54] DRY HOLE WIRE CORE BARREL APPARATUS

[75] Inventors: Ronald B. Anderson, Minneapolis; Walter W. Svendsen, New Brighton, both of Minn.

[73] Assignee: Longyear Company, Minneapolis, Minn.

[22] Filed: Apr. 11, 1974

[21] Appl. No.: 460,215

[52] U.S. Cl. ..... 294/86.34; 294/86.3; 294/86.32; 294/86.33

[51] Int. Cl.[2] ..... E21B 25/00; E21B 31/00

[58] Field of Search.... 294/86 R, 86 A, 86.1, 86.18, 294/86.19, 86.26, 86.27, 86.3–86.34, 90; 175/246, 247, 248; 285/315, 316

[56] References Cited

UNITED STATES PATENTS

| | | | |
|---|---|---|---|
| 3,127,943 | 4/1964 | Mori | 175/246 |
| 3,225,845 | 12/1965 | Koontz et al. | 175/246 X |
| 3,266,835 | 8/1966 | Hall et al. | 294/86.24 |
| 3,333,647 | 8/1967 | Karich et al. | 175/247 |
| 3,441,098 | 4/1969 | Martinsen | 175/246 |
| 3,461,981 | 8/1969 | Casper et al. | 175/246 |
| 3,666,300 | 5/1972 | Russell | 285/316 |

FOREIGN PATENTS OR APPLICATIONS

| | | | |
|---|---|---|---|
| 1,421,002 | 11/1965 | France | 294/86 A |

*Primary Examiner*—Robert S. Ward, Jr.
*Assistant Examiner*—Johnny D. Cherry
*Attorney, Agent, or Firm*—Dugger, Johnson & Westman

[57] ABSTRACT

Wire line core barrel apparatus that includes a wire line core barrel inner tube assembly movable through a drill stem to be seated in a latched core taking position adjacent the drill stem core bit, and a main overshot assembly that is coupled to a lowering overshot assembly for lowering the inner tube assembly and alternately coupled to a retracting overshot assembly for withdrawing the inner tube assembly. The inner tube assembly includes a generally annular overshot coupling member secured to a latch release tube that is mounted on a latch body to retract a pair of latches when said tube is moved axially outwardly relative the latch body, and an overshot coupling rod secured to the latch body and extended through the coupling member. The lowering overshot assembly has a lock coupling for releasably couplingly engaging the coupling rod that upon pulling on the lowering assembly with more than a given force will release coupling engagement of the lowering with the coupling rod. The retracting overshot assembly has a collet that will couplingly engage the coupling member upon lowering the retracting overshot assembly, and that upon withdrawing the retracting overshot assembly moves the latch release tube to first move the latches to a retracted position and then retract the inner tube assembly.

28 Claims, 7 Drawing Figures

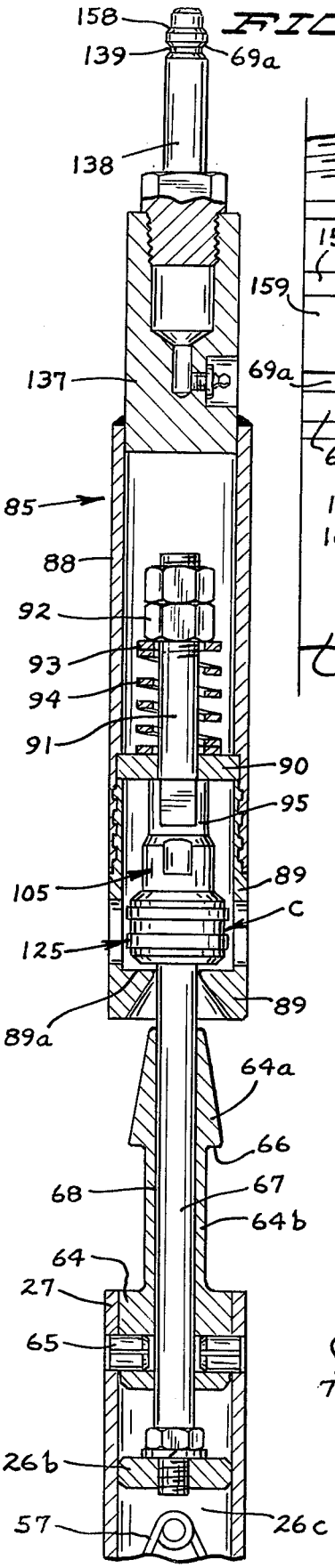
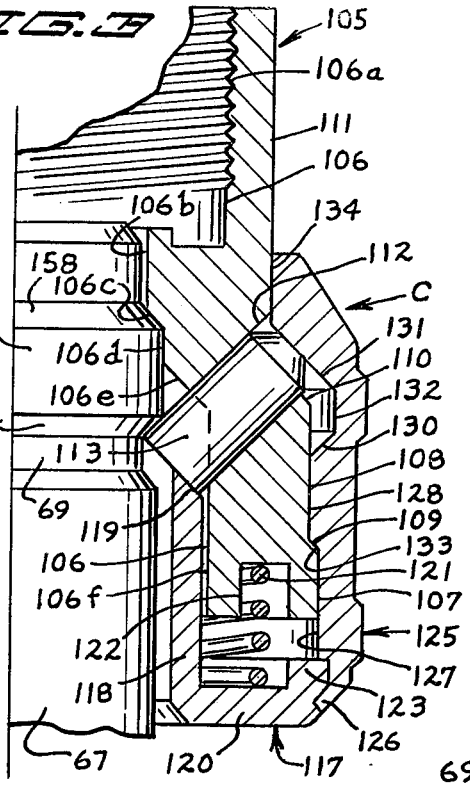
FIG. 4
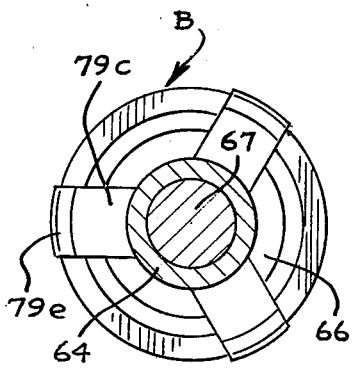
FIG. 6
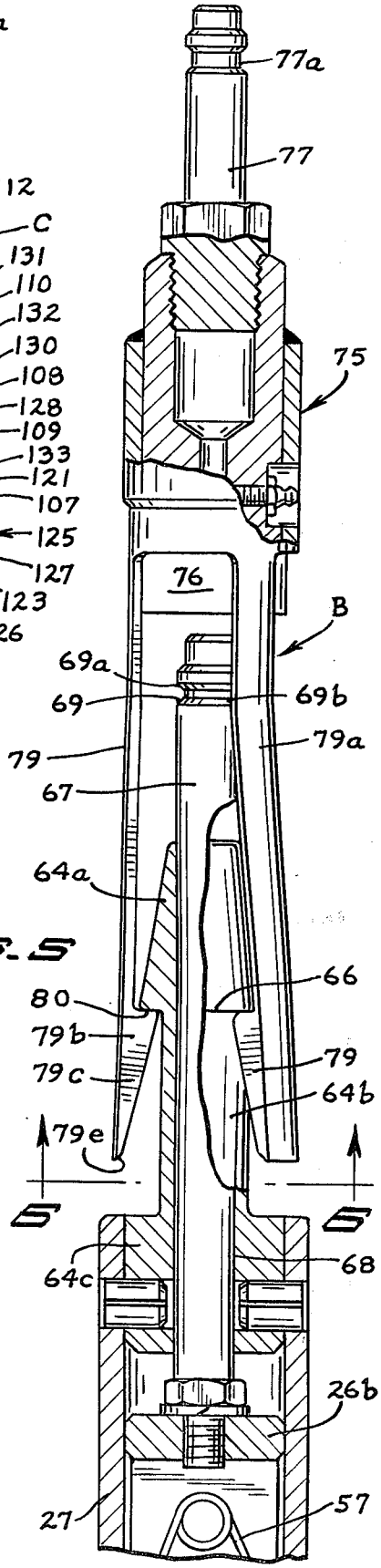
FIG. 5

DRY HOLE WIRE CORE BARREL APPARATUS

BACKGROUND OF THE INVENTION

A wire line core barrel inner tube assembly having overshot coupling mechanism.

In dry hole coring operations wherein the drilling direction is predominately downwardly, it is frequently necessary to use an overshot assembly for lowering a wire line core barrel inner tube assembly to prevent damage to the inner tube assembly that would result from allowing it to free fall to the bit end of the drill stem. In using conventional overshot assemblies in conjunction with an overshot latch release tube for decoupling the overshot assembly from the inner tube assembly when the inner tube assembly is adjacent the bit end of the drill stem, if the inner tube assembly should suddenly "hang-up" in the drill stem while being lowered, due to inertia of the overshot assembly, the latch release tube, at times, will prematurely move relative the overshot assembly to operate the overshot assembly lifting dogs (or similar members) from a coupling attachment with the inner tube assembly. As a result the inner tube assembly will be prematurely released and the inner tube assembly can drop to the bottom of the drill string in a free fall condition causing a potentially dangerous or damaging situation.

In U.S. Pat. No. 1,427,268 to Dodd there is disclosed a latch release member slidably extended through a head, for moving overshot jaws to a release position, the release member having an overshot coupling head. When using an overshot assembly for lowering the core barrel inner tube assembly of Dodd's, at times the overshot jaws will not move downwardly relative the release head sufficiently to move the jaws to an inner tube assembly release position, and as a result the core barrel inner tube assembly may have to be partially withdrawn and lowered a number of times before the inner tube assembly is released. Also there is no assurance that upper latches are properly seated when the inner tube assembly of Dodd's is released and the overshot assembly withdrawn.

In U.S. Pat. No. 3,004,614 to Janson et al., there is disclosed an overshot assembly having a locking coupling that includes detent balls for couplingly engaging the spear point head of a core barrel inner tube assembly. However, the latches for retaining the inner tube assembly in a core taking position are mounted in the drill stem. As a result the drill stem has to be withdrawn when ever the latches have to be replaced, this being undesirable.

In U.S. Pat. No. 3,225,845 to Koontz et al., there is disclosed an overshot assembly having a locking coupling that includes detent pins for couplingly engaging the spear point head of a core barrel inner tube assembly, the spear point head forming an integral part of the device for releasably locking the inner tube assembly balls in a latch seat engaging position. In the event this system is used in a drill stem of an inner diameter large enough for the inner tube assembly balls to move outwardly to a latch seat engaging position prior to these balls being radially opposite the drill stem latch seat, the inner tube assembly can be prematurely released.

In order to avoid problems such as the above, as well as others, this invention has been made.

SUMMARY OF THE INVENTION

A wire line core barrel inner tube assembly having a latch body mounting a latch for movement between a drill stem latch seat engaging position and a retracted position, a latch release member mounted on the latch body for limited movement between a first position permitting the latch moving to a latch seated position and a second position releasing the latch from the latch seated position, a first overshot coupling member secured to the latch body and adapted to be coupled to a first overshot assembly for lowering the inner tube assembly and a second overshot coupling member secured to the latch release member and adapted to be coupled to a second overshot assembly for withdrawing the inner tube assembly through the drill stem.

One of the objects of this invention is to provide new and novel overshot coupling members on a core barrel inner tube assembly to facilitate raising and lowering a core barrel inner tube assembly, and particularly to prevent the premature release from an overshot assembly during the lowering operations. In furtherance of the above object, it is another object of this invention to provide new and novel overshot mechanism for raising and lowering wire line core barrel inner tube assemblies.

BRIEF DESCRIPTION OF THE DRAWINGS

FIG. 3 is a longitudinal sectional view through the upper portion of the core barrel inner tube assembly of FIG. 1 and the lowering overshot assembly that shows said assemblies coupled together;

FIG. 4 is an enlarged fragmentary longitudinal sectional view through the overshot lock mechanism of FIG. 3 in a locked coupling position relative the coupling member that is attached to the latch body;

FIG. 5 is a longitudinal view of the upper portion of the core barrel inner tube assembly of FIG. 1, other than the inner tube assembly is shown in a retracting position, and the lifting overshot assembly, parts of said assemblies being shown in cross section, and said assemblies being shown in a coupled condition;

FIG. 6 is a transverse view generally taken along the line and in the direction of the arrows 6—6 of FIG. 5.

Figure 1:
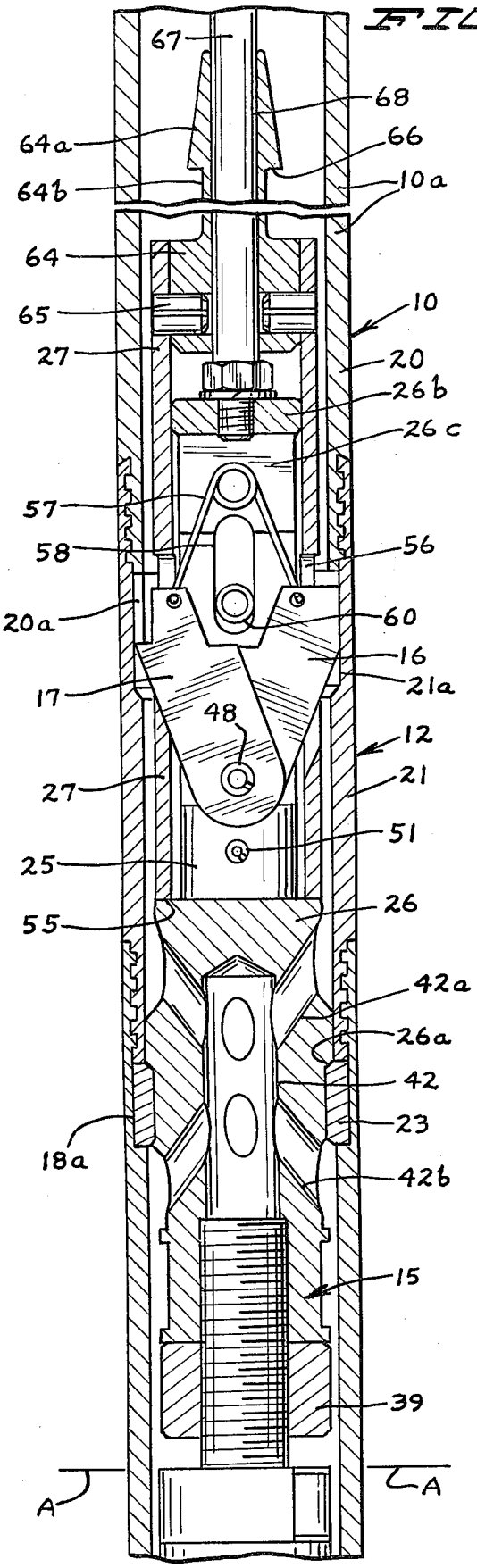
FIGS. 1 and 2 when arranged one above the other, with the center line aligned with FIG. 1 at the top and FIG. 2 at the bottom, form a composite longitudinal section through the core barrel inner tube assembly and the drill stem, said assembly being shown in a latched core receiving position. The meeting line between FIG. 1 (top) and FIG. 2 (bottom) is the line A—A.
Figure 2:
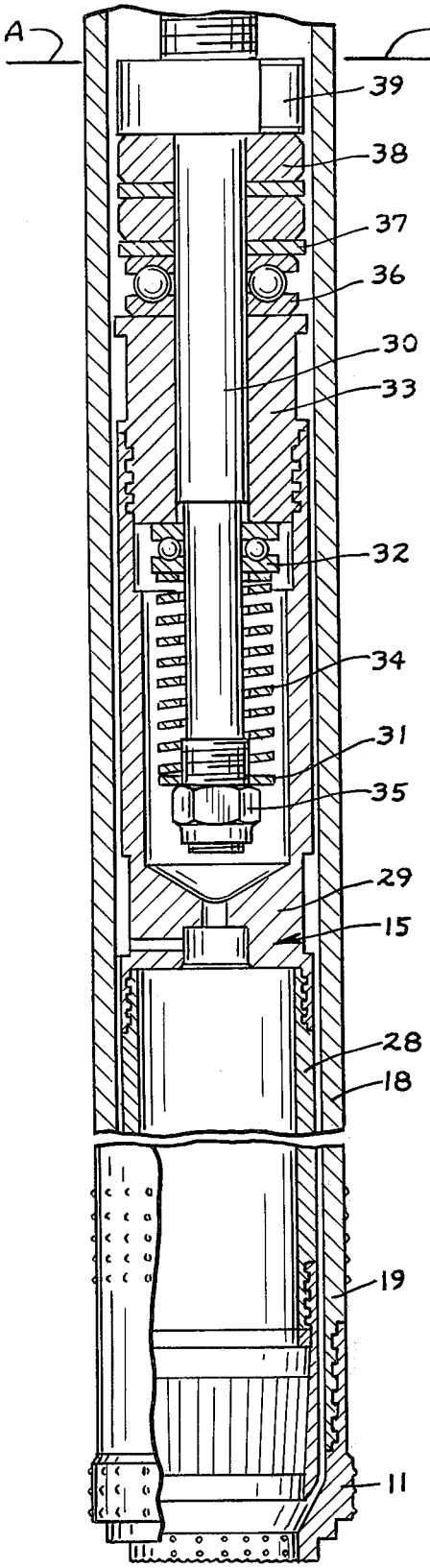

Referring now in particularly to FIGS. 1 and 2, there is illustrated a hollow drill stem 10 which is made up of sections of pipe coupled together and having an annular drill bit 11 mounted on the inner end thereof. The portion of the drill stem attached to or extending below pipe section 10A is commonly referred to as core barrel outer tube assembly, generally designated 12, which is provided for receiving and retaining a core barrel inner tube assembly, generally designated 15. Details of construction of the core barrel outer tube assembly 12 that may be used with this invention are more fully set forth in U.S. Pat. No. 3,461,981. The assembly 12 is composed of a core barrel outer tube 18, a reaming shell 19, preferably connected to lower end of tube 18, and an annular core bit 11 for drilling into the earth formation from which the core sample is to be taken, said core bit being threadly connected to the lower end of reaming shell. The outer or upper end of assembly 12 includes a lock coupling 20 which connects one end of the assembly 12 to the adjacent pipe section 10A of the drill stem. The opposite end of coupling 20 is connected to an adaptor coupling 21. The lower end of the lock coupling in conjunction with the annular recess 21A of the adaptor coupling forms a latch seat inside the surface of the adaptor coupling against which the latches (detents) 16, 17 of the core barrel inner tube assembly are seated for removably retaining the assembly 15 adjacent to the core bit. Also, the lower end portion of the lock coupling has a projection flange 20A that extends as a partial cylindrical surface to bear against a latch in a latch seating condition to rotate adjacent parts of core barrel inner tube assembly with the drill stem.

Threadedly connected to the lower end of the adaptor coupling is the upper end of the core barrel outer tube 18 which has an annular recess 18A to receivingly mount a landing ring 23 in abutting engagement with the adaptor coupling. The inner diameter of the landing ring is sufficiently smaller than the inner diameter of the remaining portion of the drill stem that is axially above the core bit to form a suspension shoulder in the core barrel outer tube.

The reaming shell and core bit cooperatively provide an annular recess (not shown) for seating a stablizer ring (not shown) in a position to aid in retaining the core barrel inner tube assembly 15 in a centralized condition relative the lower end of the core barrel outer tube assembly. The stablizer ring has circumferentially spaced teeth to provide a fluid bypass space between the ring and the core barrel inner tube assembly; the structure of the ring being more fully detailed in U.S. Pat. No. 3,461,981.

The core barrel inner tube assembly 15 includes a latch body 26 having a pair of latches 16, 17 and a latch insert block 25 mounted in an axially elongated latch body slot 26C, a latch release tube 27 for retracting said latches, an inner tube cap 29 threaded onto the upper end of a core barrel receiving (inner) tube 28, and a spindle 30 for connecting the cap to the lower end of the latch body for limited slidable movement. A bearing 32 is mounted on the spindle to abut against the inner end of a bearing housing 33 which is also slidably mounted on the spindle and is threadedly connected to cap 29; a coil spring 34 having one end abutting against said bearing 32 and an opposite end abutting against a spring retaining washer 31 that in turn abuts against a nut 35 threaded on the spindle whereby the bearing housing is rotatable and movable axially a limited amount relative the spindle. Metal washers 37 and shut off valve washers 38 together with lock nuts 39 are provided on the spindle and function in the manner described in U.S. Pat. No. 3,461,981.

The latch body has a reduced diameter lower end portion of a smaller diameter than the inner diameter of ring 23 and adjacent thereto an enlarged diametric portion that in conjunction with the reduce diameter portion provides an annular landing shoulder 26A. When shoulder 26A is seated on the landing ring 23, the core receiving tube is retained out of abutting engagement with the core barrel outer tube assembly and at the same time the fluid bypass channel 42 permits fluid to flow from the annular space between the core barrel inner tube assembly and the core barrel outer tube assembly that is above ring 23 to the annular clearance space axially below ring 23. That is, when the core barrel inner tube assembly is in a latch seated core taking position. the fluid bypass channel 42 has inlet ports 42A opening to the fluid clearance space between the inner tube assembly and the outer tube assembly axially above ring 23, and outlet ports 42B that open to the fluid clearance space below ring 23.

A through pin 51 mounts the insert block in the latch body slot while a through pin 48 mounts the latches 17, 16 for pivotal movement between retracted and latched seated positions. The latch release tube 27 is mounted on the upper reduced diameter portion of latch body for limited axially slidable movement relative thereto between a position abutting against latch body shoulder 55 to permit the latches moving to a latch seated position, and a latch retracted position axially thereabove. Tube 27 has diametrically opposed slots 56 through which the outer transvered corner portions of the latches may extend to latchingly engage latch seat 21A, a torsion spring 57 being provided for resiliently urging the latches to pivot about through pin 48 to positions to latchingly engage the latch seat. An axially elongated slot 58 is formed in the latch body on either side of slot 26C to extend transversely thereto. A through pin 60 is extended through the slots 26C, 58 and has its opposite ends mountingly retained within opposed apertures in the latch release tube to move therewith. The slots 58 extend axially inwardly sufficiently such that when the pin 60 abuts against the inner edges thereof, the pin is located transversely intermediate the latches, and the latch release tube abuts against the latch body shoulder 55; and the pin in an axially outer position, the latch release tube is moved sufficiently relative the latch body to retract the latches. Thus, pin 60 allows limited movement of the latch release tube relative the latch body.

An annular overshot withdrawing plug (coupling member) 64 has a lower (axially inner) end portion extended into the latch release tube and secured to said tube by pins 65 to prevent movement of the plug relative the tube. A substantial distance axially above the release tube, plug 64 has an outer (upper) end portion 64A. Portion 64A has a frusto conical outer surface, the major base end of portion 64A being joined to intermediate diameter portion 64B to provide a downwardly spacing, annular shoulder 66. An overshot engagable, lowering coupling rod 67 is slidably extended through the central aperture 68 of the plug 64 and has a lower end threaded into the upper end portion 26B of the overshot body. Rod 67 is of an axial length to have the upper end portion thereof extend a substantial distance above the upper end portion of plug 64, even when the latch release tube is in its fully retracted position relative the latch body.

A short distance axially inwardly of the top of the coupling rod, it is provided with a detent receiving circumferential groove 69 that is located a substantial distance axially outwardly of the top of the plug outer portion 64A, even when the latch release tube is in its maximum retracted position relative the latch body.

Groove 69 is in part formed by axially opposite upper and lower annular shoulders 69A and 69B respectively that are tapered radially inwardly in axial directions toward one another.

For retracting the core barrel inner tube assembly through the drill stem, there is provided a lifting (retracting) overshot assembly, generally designated 75, that includes an overshot body 76 having a spindle 77 connected thereto extended axially thereabove (see FIG. 5). The upper end portion of the spindle has a circumferential overshot coupling groove 77A. Mounted on the overshot body to extend downwardly therefrom is a gravity overshot lifting collet, generally designated B, that advantageously has three spring fingers 79. Each of these fingers includes an axially elongated stem portion 79A extending below the overshot body, and an enlarged lower end jaw portion 79B that at its junction to the stem portion 79A extends a substantial distance further radially inwardly than the adjacent part of the stem portion to provide a lifting shoulder 80. Each of the portions 79B has a radially inner, downwardly and radially outwardly inclined surface 79C, said surface in a transverse plane being circumferentially curved. Surfaces 79C facilitate the spreading of the fingers as the fingers are moved outwardly over the top part of head portion 64A, the lower end portions of the fingers being resiliently retained in a datum position to have surfaces 79C at their upper circumferential edges approximately located on a circle of a radius of curvature slightly greater than the radius of the minor base of the frusto conical surface of portion 64A and substantially smaller than the radius of the major base of said frusto conical surface. Further, the radius of curvature of the last mentioned circle is substantially the same or only slightly greater than the radius of the outer surface of stem portion 64B. The lower, circumferential edges 79E of surfaces 79C, in the datum position of the fingers, are approximately located on a circle of a radius slightly greater than the radius of the major base of the frusto conical surface of portion 64A. As a result of the taper of the surfaces 79C and the taper of the frusto conical surface of portion 64A, as the overshot assembly 75 is lowered, surfaces 79C in abutting against the head portion 64A force the jaws 79B to spread sufficiently to permit jaws 79B moving downwardly along overhead portion 64A and then the jaws resiliently move radially toward one another after the top edges of the jaw surfaces move below portion 64A. Now, upon retracting the overshot assembly 75, the shoulders 80 are moved into abutting engagement with the annular shoulder at the juncture of portions 64A, 64B, and upon further retracting movement, move plug 64 axially upwardly with overshot assembly 75.

In connection with above, it is to be noted that in the datum position of the fingers the adjacent parts of jaws 79B are spaced sufficiently to permit rod 67 moving axially therebetween. Further, the stem portions 79A are of sufficient axially lengths that shoulders 80 may be axially lower than the major base of head portion 64A when the latch release tube is in its retracted position and still the lower surface of the overshot body 76 is vertically above the top of the coupling rod 67.

Referring in particular to FIG. 3, the lowering overshot assembly, generally designated 85, includes an overshot tube 88. The lower end of tube 88 is threadingly connected to an annular overshot fitting 89 in a manner to provide an annular recess in which an annular member 90 is mounted. An axially elongated spindle 91 has a nonthreaded intermediate portion axially slidably extended through the annular member 90 and an upper threaded end on which there are threaded nuts 92 with a washer 93 being resiliently retained in abutting relationship to lower nut 92 by a spring 94 surrounding the spindle. The lower end of the spring abuts against the mounting member 90, a lock mount 95 being secured to the lower end of spindle to be abuttable with the undersurface of the annular member for limiting the upward movement of the spindle and mount 95 relative the fitting 89, and being located within the fitting.

The overshot assembly 85 includes lock mechanism, generally designated C (see FIGS. 3 and 4), that includes an annular detent mounting member, generally designated 105. The detent mounting member 105 has a central bore 106 extending axially therethrough that includes an upper, internally threaded bore portion 106A forming a matching fit with the lower threaded end of the mount 95. It is to be understood mount 95 and the detent mounting member can be a single member. Below bore portion 106A there is cylindrical, reduced diameter bore portion 106B that in turn opens to the frusto conical, downwardly diverging bore shoulder portion 106C. The major base of shoulder 106C opens to the cylindrical bore portion 106D which in turn opens to the minor base end of the frusto conical shoulder 106E. The major base end of the shoulder 106E opens to the cylindrical lower bore portion 106F. Further, the detent mounting member has a lower, radially outer cylindrical surface portion 107, the upper end of which is joined to the radially outer cylindrical surface portion 108 to provide an upwardly facing annular shoulder 109. The upper end of surface portion 108 is joined to the major base end of the frusto conical, radially outer surface portion 110, the minor base end being joined to the lower end of the cylindrical surface portion 111. The detent mounting member is provided with a plurality of circumferentially spaced detent mounting bores 112 that have central axes inclined axially downwardly in a radial inward direction. Bores 112 open through shoulders 106E and 110. Mounted in the bores are detent pins 113 that are of axial lengths greater than the axial length of the bores 112.

The lock mechanism also includes a release sleeve, generally designated 117, that has an axially elongated annular flange 118 axially slidably extended into bore portion 106F to form a close fit therewith. Further, the sleeve 117 includes a radially outwardly extending annular flange 120 joined to the lower end of flange 118, the upper end of flange 118 having a frusto conical ramp surface 119. Flange 118 is of an axial length that when the ramp surface 119 abuts or substantially abuts against shoulder 106E, flange 120 abuts against the lower end of the detent mounting member whereby the upward movement of the release sleeve relative the detent mounting member is limited. A coil spring 121 is extended into a downwardly opening annular groove 122 provided in the detent mounting member, one end of the spring bearing against the detent mounting member and the opposite end against the flange 120 for resiliently urging the release sleeve axially downwardly relative the detent mounting member.

Mounted on the detent mounting member for limited axial movement relative thereto is a locking collar, generally designated 125, the collar having a radially inwardly extending flange 126 that extends into an annular groove in the annular flange 123 to prevent axial movement of the locking collar relative to the sleeve. Flange 123 is integrally joined to the radially outer edge of flange 120. The locking collar has a cylindrical lower bore portion 127 that opens to the flange 123 and that is of a substantially longer axial length than surface portion 107. The lower end of the intermediate bore portion 128 at its juncture with bore portion 127 provides a shoulder 133 that is seatable against shoulder 109 for limiting the downward movement of the collar relative the detent mounting member. Just above bore portion 128, the detent mounting member has an enlarged diametric bore portion to provide an annular groove 132 that has an axial intermediate portion of a substantial axial length and of a diameter substantially greater than the diameter of the surface portion 108. Groove 132 in part is formed by upper and lower frusto conical surfaces 131 and 130 that respectively converge in a radially outward direction toward the intermediate part of the groove. The lower annular edge of surface 130 terminates at the upper edge of cylindrical surface 128 which forms a close sliding fit with surface portion 108. The radially inward, upward part of surface 131 is abutable against shoulder 110 to substantially form a matching fit therewith, the upper edge of surface portion 131 being joined to the lower end of cylindrical bore portion 134 that is of a diameter to form a close sliding fit with surface portion 111.

As may be noted in FIG. 4, when the frusto conical surface 131 abuts against surface portion 110, it also abuts against the detent pins 118 whereby the detent pins are in part retained in abutting relationship with ramp surface 119 and in part extend radially inwardly of the inner peripheral wall of the flange 118 to be extendable into groove 69 to prevent coupling member 67 being withdrawn from the lock mechanism until the locking collar is moved axially upwardly relative the detent mounting member. When the lock collar is moved axially upwardly to its upper limit position relative the detent mounting member, the ramp surface 119 forces the detent pins axially upwardly and radially outwardly relative the detent mounting member to positions that the detent pins are located more remote from the central axis of the lock mechanism than the inner peripheral wall of flange 118. As the ramp surface 119 is moved upwardly, the detent pins bear against progressively lower parts of surface 131 that are more further radially remote from the central axis whereupon in the upper limit position of the sleeve, the upper ends of the detent pins extend into the annular groove 132. The spring 121 constantly urges the sleeve and collar axially downwardly relative the detent mounting member whereby the surface 131 forces the detent pins 113 radially inwardly and axially downwardly to the locking positions of FIG. 4, the detent pins having end portions abutting against the ramp 119 for retaining the detent pins in the detent bores in the lower position of the release sleeve.

Referring to FIG. 3, secured to the upper end of the tubular member 88 is a plug 137 which in turn mounts a coupling member 138 to extend axially outwardly thereof. The upper end portion of coupling member 138 is provided with a detent pin receiving circumferential groove 139 that is of a size and shape for receiving detent pins 113 in a locking position such as described with reference to the coupling member 67 and detent pins of FIG. 4.

Figure 7:
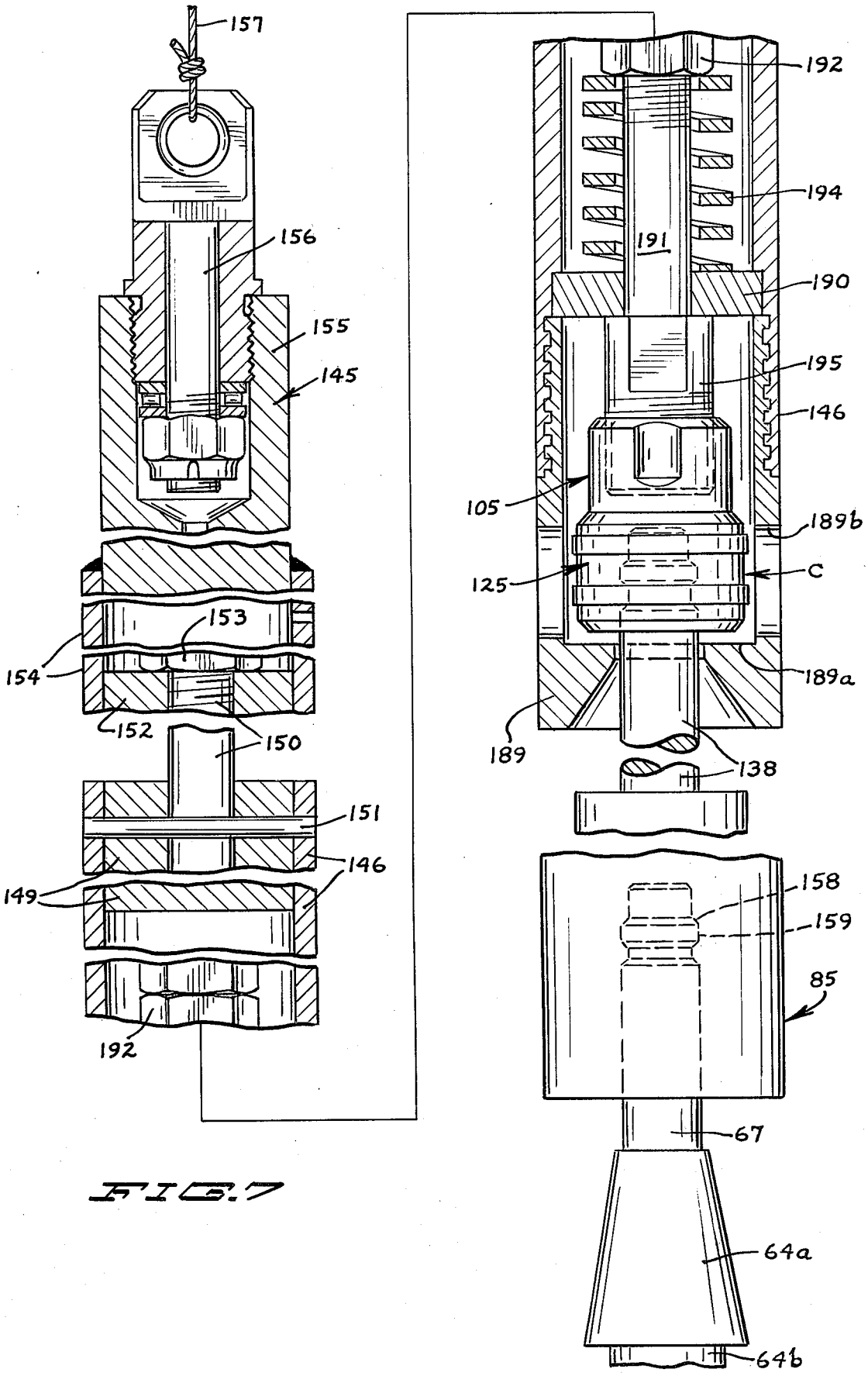
FIG. 7 is view of the main overshot assembly couplingly engaged with the lowering overshot assembly which in turn is couplingly engaged with the coupling member attached to the latch body during a lowering operation, parts of said view being shown in longitudinal cross section and various axially intermediate parts being broken away.

Referring to FIG. 7, the main overshot assembly, designated 145, includes an overshot tube 146 that at its lower end is threadly connected to an overshot fitting 189 for mounting a mount 190 in the same manner as described with reference fitting 89 and mount 90 of the lowering overshot assembly. The assembly 145 also includes a nut 192, a coil spring 194, a spindle 191, a mount 195, and lock mechanism C that are of the same construction and mounted in the same manner as that described with reference to the corresponding members of assembly 85; except that the spring 194 has substantially stronger spring characteristics than the spring 94. The upper end of the tube 146 has a lower jaw element 149 pinned thereto by a pin 151, the pin 151 extending through the lower end of the jaw shaft 150 to mount it in a fixed position relative the jaw element 149. The shaft 150 is slidably extended through the upper jaw element 152 and has a nut 153 threaded thereon for limiting the upward movement of the jaw element 152 relative the shaft 150. The jaw element 152 is welded or threadly connected to the lower end of the jaw element tube 154. The shaft 150 is of a substantial axial length to permit the jaw elements 152, 149 being moved apart in a conventional manner and element 152 being dropped to abut against element 149 for applying a hammering force thereto in a conventional manner. The upper end of the jaw tube 154 mounts a swivel collar 155 which in turn mounts an eye bolt 156. A wireline cable 157 is attached to the eye bolt.

In using the apparatus of this invention the coupling member 138 of the assembly 85 is pushed into the bore of the annular flange 118 so that the shoulder 158 contacts the detent pins 113 to move the detent pins axially and radially outwardly relative the detent mounting member, and thereby permit the cylindrical diametric portion 159 of the coupling member 138 moving axially above the pins. That is, due to the angle of tapered surface 158, the angles of the radially inner ends of the detent pins, and the angle of the outer ends of the pins together with the angle of taper of surface 131, as surface 158 abuts against the inner end of pins 113, the pins are moved radially and axially outwardly. This movement of the pins in turn forces the locking collar 125 and thereby the release sleeve 117 to move axially upwardly relative the detent mounting member. When members 117, 125 have been moved sufficiently upwardly relative the detent mounting member, the pins 113 then slide along surface 159, and upon being radially adjacent surface 69A, the coil spring 121 forces the release sleeve and locking collar downwardly relative the detent member and coupling member 138 so that the detent pins extend into groove 69. Now, the resilient downward force exerted by spring 121 on the release sleeve 117 relative to the detent mounting member, and abutting shoulders 109, 133 and 110, 131 prevent the locking collar and release sleeve moving downwardly relative the detent mounting member sufficiently so that the coupling member 138 is released.

With the overshot assemblies 85 and 145 coupled together in the above manner, coupling member 67 is pushed into the locking mechanism C of the overshot assembly 85 for coupling the core barrel inner tube assembly to the lowering overshot assembly in the same way that the overshot assembly 85 is coupled to the main overshot assembly 145. Thereafter the core barrel inner tube assembly, with the latches in their retracted position, and assemblies 85, 145 are lowered through the drill stem to positions that the latches are radially adjacent the latch seat. At this time, the torsion spring 57 forces the latches to a latch seated position. After the latches are seated, a retracting force is exerted on cable 157. Since the force required to be exerted on assembly 145 for moving spindle 191 thereof against the resilient action of spring 194 to a position that the coupling C of assembly 145 abuts against the upward facing shoulder 189A of the overshot fitting 189 is much greater than that required for moving the spindle 91 downwardly against the action of spring 94 of assembly 85, the retracting force moves assemblies 145, 85 upwardly except for spindle 91 and the coupling C thereon. However, since the core barrel inner tube assembly is latched in position, the coupling element 67 cannot move upwardly therewith. As a result mount 90 moves upwardly relative to spindle 91 whereupon the shoulder 89A is moved into abutting relationship with flange 120 of the lock mechanism of assembly 85. The shoulder 89A now moves the release sleeve and locking collar upwardly relative the detent mounting member to a position that ramp surface 119 cams the detent pins 113 out of the groove 69 of the coupling member 67. Once the detent pins have cleared the groove, spring 94 moves the spindle 91 upwardly relative the mounting element 90 whereby the detent pins slide along the surface 159 to release the coupling engagement between the lock mechanism C of the assembly 85 and coupling member 67. Now the overshot assemblies 85 and 145 are retracted, the core barrel inner tube assembly being left in a latch seated position in the lower end of the drill stem.

For retracting the core barrel inner tube assembly, first the overshot assembly 85 is disattached from the assembly 145, for example, by exerting a pulling force on the coupling member 138 to move the spindle 91 downwardly sufficiently that the locking collar of assembly 85 is moved to the release position relative the detent mounting member; or alternately, by inserting a tool or fingers through the fitting slot 189B to move the locking collar upwardly relative the detent mounting member to an unlocking position. Thereafter, the coupling member 77 of the retracting overshot assemblies 75 is pushed into the lock mechanism C of assembly 145 to a position that the detent pins 113 extend into the groove 77A. Now the coupled assemblies 75, 145 are lowered in the drill stem, the surfaces 79C of the overshot jaws 79B abutting against the outer surface of frusto conical portion 64A spreading the jaws apart sufficiently that the jaws will move axially inwardly to a position that the shoulders 80 underlie the annular major base shoulder 66 of head 64A. Now a retracting force is applied through cable 157 to assembly 145 which in turn retracts assembly 75. Initial retraction of assembly 75 operates through the coupling member 64 to retract the latch release tube and thereby move the latches of the latching engagement with latch seat of the drill stem. Further retraction of the latch release tube moves the pin 60 to the upper ends of the latch body slots 58, and thereupon the entire core barrel inner tube assembly is retracted.

It is to be mentioned that the coupling C can be of modified construction wherein detent balls are used in place of detent pins, and further modified, provided that it is of a construction that after a sufficiently large force is exerted on the coupling, the coupling collar will move downwardly to abut against shoulder 89A (or 189A) for operating the coupling to the coupling member release position in a manner corresponding to that described herein.

As an example of the invention but not otherwise as a limitation thereon, the spring 94 has spring characteristics such that, for example, three to four hundred pounds pulling force is required to be exerted on the assembly 85 in a direction away from coupling member 67 to disengage the coupling attachment between the coupling C thereof and coupling member 67 while the spring 194 has spring characteristics such that about a thousand pound pulling force is required to be exerted on the assembly 145 for disconnecting the coupling attachment between the coupling C thereof and the coupling member 138 or coupling member 77. That is, the characteristics of springs 94 and 194 are such that a much greater force is required to separate assembly 145 from either assembly 85 or assembly 75 than to separate assembly 85 from the core barrel inner tube assembly by pulling the assemblies apart. As a result, the coupled assemblies 85, 145 will not be accidentally decoupled, but on the other hand will permit the assemblies being decoupled prior to a sufficient force being exerted on the cable 157 to break the cable.

To be noted is that in lowering the core barrel inner tube assembly with assembly 85, in the event the inner tube assembly suddenly stops and the overshot assembly tends to move downwardly relative the inner tube assembly, shoulder 158 will abut against shoulder 106C to prevent the coupling C abutting against shoulder 89A. As a result, coupling C cannot be accidently operated to prematurely release the inner tube assembly due to a sudden stop or "hang-up" of the inner tube assembly in the drill stem.

With the apparatus in this invention, when the core barrel inner tube assembly is in the drill stem, it is to be retained in the latch seated position while a relatively high pulling force is applied through the wireline cable in order to separate the coupling attachment between the core barrel inner tube assembly and the assembly 85. As a result, during a lowering operation, the core barrel inner tube assembly cannot accidentally be prematurely released from the overshot assembly in the event that for some reason, the latches were not seated in a latch seated condition. Further retracting the combination overshot assembly 85, 145 will retract the core barrel inner tube assembly if the latches are not properly seated.

Additionally, due to the provision of assembly 145, a hammering force can be applied to the respective assembly 75, 85, if needed. However, it is to be understood by using eye bolts and wire cables attached thereto in place of coupling members 77 and 138, overshot assemblies 75 and 85 may be used be raising and lowering core barrel inner tube assemblies without using assembly 145.

What is claimed is:

1. A wire line core barrel inner tube assembly comprising tubular means for receivingly retaining a core therein, a latch body, means for connecting the core receiving means to the latch body, a latch mounted on the latch body for limited movement relative thereto between a drill stem latch seat engaging position and a retracted position, latch release means mounted on the latch body for limited movement relative thereto for releasing the latch from the drill stem latch seat engaging position, and a first overshot coupling member fixedly secured to the latch body.

2. The apparatus of claim 1 further characterized in that there is provided a second overshot coupling member that is fixedly secured to the latch release means.

3. The apparatus of claim 2 further characterized in that said release means comprises a latch release tube having the latch body extended thereinto, that said second coupling member is annular and has one end portion secured to the latch release tube remote from the latch body and an opposite end portion more remote from the latch body than said one end portion, said first coupling member being slidably extended into the annular coupling member.

4. The apparatus of claim 3 further characterized in that each of the latch release tube and latch body are axially elongated, that the latch release tube is mounted on the latch body for limited axial movement relative thereto, that said second overshot coupling member is secured to the latch release tube to extend axially outwardly thereof in a direction away from the latch body and that the first overshot coupling member is axially elongated and of an axial length to extend through the annular coupling member to a location substantially axially more remote from the latch release tube than the annular coupling member in both of the latch release means limited positions.

5. The apparatus of claim 4 further characterized in that said annular member opposite end portion has a frusto conical outer surface having a major base and a minor base axially more remote from the latch release tube than the major base, and that said annular member has an axially elongated intermediate portion axially between said annular member end portions that is of a smaller outer diameter than the major base and is joined to said annular member opposite end portion to form an annular shoulder facing toward said one end portion.

6. The apparatus of claim 4 further characterized in that said first coupling member has an outer end portion that has a circumferential overshot assembly detent receiving groove.

7. The apparatus of claim 6 further characterized in that said second coupling member opposite end portion has a frusto conical surface having a minor base and a major base substantially more closely adjacent the latch release tube than the minor base, and that the second coupling member has an axially extending intermediate portion having an outer diameter substantially smaller than the corresponding dimension of the major base and is joined to the second member opposite end portion to form a shoulder facing toward the second coupling member one end portion.

8. The apparatus of claim 7 further characterized in that there is provided an overshot assembly having an overshot body and plurality of axially elongated, circumferentially spaced spring fingers, each of the spring fingers having one end portions joined to the overshot body and opposite jaw end portions substantially axially spaced therefrom, for couplingly engaging said second coupling member, said jaws being resiliently retained in a radially spaced datum position and having shoulders for abuttingly engaging the coupling member shoulder to transmit a lifting force thereto.

9. The apparatus of claim 8 further characterized in that said jaw end portions have radially inner, axially downwardly and radially outwardly tapered surfaces that in a transverse plane through the radially most closely adjacent parts of the jaw end portions are generally circumferentially curved about a circle having a radius of curvature in a finger datum position greater than one half the maximum transverse dimension of part of the first coupling member that extends more remote from the latch release tube than the second coupling member, said radius of curvature being substantially smaller than the radius of the major base.

10. The apparatus of claim 1 further characterized in that the latch release means comprises an axially elongated latch release tube that is mounted on the latch body for limited axial movement relative thereto between a latch retracting position and a position permitting the latch moving to the latch seat engaging position, said latch body extending into the latch release tube, said tube having a latch slot for the latch to extend through in the latch drill stem latch seat engaging position, that the latch is pivotally mounted on the latch body for movement between the latch positions, and that there is provided a second overshot coupling member that is annular and has one end portion fixedly secured to the latch release tube axially outwardly of the pivotal connection of the latch to the latch body and an opposite end portion axially outwardly of said one end portion, said first coupling member being slidably extended through the second coupling member, axially elongated, and of an axial length to extend to a location substantially more remote from the latch release tube than the second coupling member opposite end portion in both the latch release tube positions.

11. Wire line core barrel apparatus operable through a drill stem, comprising a wire line core barrel inner tube assembly having an axially outer overshot coupling member, said coupling member comprising an axially extending rod that includes a portion having a circumferential detent receiving groove, and an overshot assembly for couplingly engaging the said rod, said overshot assembly having an annular detent mounting member for receiving said rod portion therein, a detent mounted by the detent mounting member for a movement between a first position extendable into said groove and a rod portion release second position, ramp means mounted on the detent mounting member for limited axial movement between a first position retaining the detent in the detent first position and a second position axially outwardly of the ramp means first position to permit the detent moving to its second position, resilient means acting against the ramp means for resiliently retaining the ramp means in the ramp means first position relative the detent mounting member, an axially elongated tubular overshot member having an axially inner end portion into which the rod portion is extendable, and means for mounting the detent mouting member in the tubular member in a position that the rod end portion is movable into the detent mounting member to abut against the detent when the ramp means is in the ramp means first position, and through the detent, force the ramp means to its second position whereby the rod portion is movable relative the detent and detent mounting member to a position that the detent is moved to extend into said groove and the ramp means then moves to its first position to retain the detent in the detent first position, and means for attaching a wire line cable to the tubular member, the tubular member having an axially inner end portion abuttable against the ramp means to limit the axially inward movement of the ramp means and the detent mounting member mounting means including means mounting the detent mounting member for axial inwardly movement relative the tubular member to a first position that the ramp means abuts against said tubular member portion with the ramp means in its second position relative the detent mounting member, and an axially outer position that the ramp means in each of its positions relative the detent mounting member is axially spaced from said tubular portion, and resiliently retaining the detent mounting member from moving to its first position until an axially inward force exerted thereon is substantially greater than the weight of the core barrel inner tube assembly.

12. The apparatus of claim 11 further characterized in that the wire line cable attaching means includes an overshot coupling rod connected to the tubular member to extend axially outwardly thereof, said overshot coupling rod having an outer end portion that has a circumferential detent receiving groove, an overshot device, operable detent lock means for lockingly engaging said overshot rod portion, including a detent adapted for movement into the overshot rod portion groove, said lock means being operable to a rod release position, means for mounting the lock means on the overshot device for limited axial movement relative thereto between a datum position and a position axially inwardly of the last mentioned datum position, and resiliently retaining the lock means in the said last mentioned datum position, and a fitting mounted on the overshot device to extend axially inwardly thereof for operating the lock means to its release position as the lock means moves relative the overshot device to the position axially inwardly of said last mentioned datum position, and means for attaching a wire line cable to said overshot device.

13. The apparatus of claim 12 further characterized in that means for mounting the lock means includes means, that requires a substantial greater force to be deformed than a force to similarly deform the means for resiliently retaining the detent mounting member, for resiliently retaining the lock means in said last mentioned datum position.

14. An axially elongated core barrel inner tube assembly movable through a drill stem by an overshot assembly comprising tubular means for receivingly retaining a core sample, a latch body, means for mounting the core sample retaining means on the latch body axially inwardly of the latch body, a latch mounted on the latch body for limited movement relative thereto between a drill stem latch seat engaging position and a retracted position, means for resiliently urging the latch to the latch seat engaging position, an axially elongated latch release tube mounted on the latch body for limited movement between an axial inner position permitting the latch moving to the latch seat engaging position and an axial outer position retracting the latch, a first overshot engagable coupling member adapted for being couplingly engaged by an overshot assembly for lowering the latch body through the drill stem, and a second coupling member adapted for being couplingly engaged by an overshot assembly for moving the latch release tube from the tube first position to the tube second position, said second coupling member being mounted on the latch release tube and the first coupling member being mounted on the latch body.

15. The apparatus of claim 14 further characterized in that said first coupling member is extended through the second coupling member and axially movable relative thereto, said first coupling member being of an axial length to extend axially outwardly of the second coupling member in each of the latch release tube positions.

16. The apparatus of claim 15 further characterized in that the overshot assembly adapted for couplingly engaging the first coupling member includes an overshot body having an axially inner end portion and means for coupling engaging the first coupling member and retaining the coupling engagement therewith until more than a predetermined force is exerted thereto in a direction to move the overshot body axially away from the latch body, the last mentioned means being mounted on the overshot body inner end portion.

17. For lowering a wire line core barrel inner tube assembly having an overshot coupling member through a drill stem, an overshot mechanism comprising an axially elongated overshot member, operable detent lock means for lockingly engaging said coupling member, said lock means being operable to a coupling member release position, means for mounting the lock means on the overshot member for limited axial movement relative thereto between a datum position and a position axially inwardly of the datum position, and resiliently retaining the lock means in the datum position, a fitting mounted on the overshot member to extend axially inwardly thereof for operating the lock means to its release position as the lock means moves relative the overshot member to the position axially inwardly of the datum position, and means for attaching a wire line cable to the overshot member axially outwardly of the fitting.

18. The apparatus of claim 17 wherein said coupling member includes a circumferential overshot detent receiving groove, further characterized in that the lock means includes a detent adapted for movement into said groove, a detent mount mounted on the means for mounting the lock means for mounting the detent for movement between a coupling member release position and a coupling locking engagement position, and annular means abuttable against the fitting and movably mounted on the detent mount for moving the detent out of the groove as the lock means moves axially inwardly of the datum position, said fitting being annular and having a shoulder abuttable against the annular means to limit the axial inward movement thereof when the detent mount is moved axially inwardly.

19. The apparatus of claim 17 further characterized in that the lock means includes a lock member, means mounting the lock member for limited movement between a coupling member locking position and a coupling member release position, the lock member mounting means being mounted on the means for mounting the lock means, lock operating means mounted on the lock member mounting means for moving the lock member between its positions and being movable between a first position to retain the lock member in the coupling member locking position and an axially outwardly second position to retain the lock member in the release position, and means for resiliently urging the lock operating means to its first position, said means for mounting the lock means including means for mounting the lock member mounting means for limited axial movement, resiliently retaining the lock member mounting means in a datum position and permitting limited axial movement thereof to a second position axially inwardly of the last mentioned datum position, said lock operating means being abuttable againt the fitting to limit the axial inward movement thereof as the lock member mounting means moves it to its second position to thereby operate the lock operating means to the lock member release position.

20. The apparatus of claim 17 further characterized in that the fitting is mounted on the overshot member in a fixed axial position relative thereto.

21. A wire line core barrel inner tube assembly comprising means for receivingly retaining a core, latch body, means for connecting the core receiving means to the latch body, a latch mounted on the latch body for limited movement relative thereto between a drill stem latch seat engaging position and a retracted position, latch release means mounted on the latch body for limited movement relative thereto for releasing the latch from the drill stem latch seat engaging position, said release means comprising an axially elongated latch release tube mounted on the latch body for limited axial movement relative thereto and having the latch body extended thereinto, an axially elongated first overshot coupling member fixedly secured to the latch body and having an outer end portion that has a circumferential overshot assembly detent receiving groove, an annular second overshot coupling member fixedly secured to the latch release tube to extend axially outwardly therefrom in a direction away from the latch body and having one end portion secured to the latch release tube remote from the latch body, an opposite end portion more remote from the latch body than said one end portion and having a frusto conical surface having a minor base and a major base substantially more closely adjacent the latch release tube than the minor base, and an axially extending intermediate portion having an outer diameter substantially smaller than the corresponding dimension of the major base and joined to the second member outer end portion to form a shoulder facing toward the second coupling member one end portion, said first coupling member being slidably extended into the annular coupling member and being of an axial length to extend through the annular coupling member to a location substantially axially more remote from the latch release tube than the annular coupling member in both of the latch release means limited positions, and an overshot assembly having overshot body and a plurality of axially elongated, circumferentially spaced spring fingers, each of the spring fingers having one end portions joined to the overshot body and opposite jaw end portions substantially axially spaced therefrom, for couplingly engaging said second coupling member, said jaws being resiliently retained in a radially spaced datum position and having shoulders for abuttingly engaging the coupling member shoulder to transmit a lifting force thereto, an overshot coupling rod attached to the overshot body to extend axially outwardly thereof and having circumferential detent receiving groove axially outwardly of the overshot body, and means for attaching a wire line cable to the overshot assembly, the last mentioned means including an overshot device having an axially inner end portion and means for coupling engaging the overshot coupling rod and retaining the coupling engagement therewith until more than a determined force is exerted in a direction to move the overshot device axially away from the overshot coupling rod, the last mentioned means being mounted on the overshot body inner end portion and including operable detent lock means for lockingly engaging said overshot rod, said lock means being operable to a rod release position, means for mounting the lock means on the overshot device for limited axial movement relative thereto between a datum position and a position axially inwardly of the datum position, and resiliently retaining the lock means in the datum position, and a fitting mounted on the overshot device to extend axially inwardly thereof for operating the lock means to its release position as the lock means moves relative the overshot device to a position axially inwardly of the datum position, and means for attaching a wire cable to the overshot device axially remote from the lock means.

22. A wire line core barrel inner tube assembly comprising means for receivingly retaining a core, an axially elongated latch body, means for connecting the core receiving means to the latch body, a latch mounted on the latch body for limited movement relative thereto between a drill stem latch seat engaging position and a retracted position, latch release means mounted on the latch body for limited movement relative thereto for releasing the latch from the drill stem latch seat engaging position, said release means comprising an axially elongated latch release tube mounted on the latch body for limited axial movement relative thereto and having the latch body extended thereinto, an axially elongated first overshot coupling member fixedly secured to the latch body and having an outer end portion that has a circumferential overshot assembly detent receiving groove, an annular second overshot coupling member fixedly secured to the latch release tube to extend axially outwardly therefrom in a direction away from the latch body and having one end portion secured to the latch release tube remote from the latch body, an opposite end portion more remote from the latch body than said one end portion, said first coupling member being slidably extended into the annular coupling member and being of an axial length to extend through the annular coupling member to a location substantially axially more remote from the latch release tube than the annular coupling member in both of the latch release means limited positions, and an overshot assembly for lowering the core barrel inner tube assembly, said overshot assembly including an overshot coupling device for releasably couplingly engaging the first coupling member, overshot means for mounting the coupling device, said device including an annular detent mounting member having an axially inner bore portion of a larger diameter than the maximum outer diameter of the first coupling member outer end portion for receiving the last mentioned outer end portion therein, a detent mounted by the detent mounting member for limited movement relative thereto between a first coupling member locking position extendable into said groove and a first coupling member release position, ramp means mounted on the detent mounting member for limited movement relative thereto between a first position for retaining the detent in its locking position and a second position permitting the detent moving to its release position, means acting between the detent mounting member and the ramp means for resiliently urging the ramp means to its locked position, and means mounted by the overshot means for mounting the detent mounting member for limited axial movement and resiliently retaining the detent mounting member in a datum axial position while permitting the detent mounting member moving relative the overshot means to a second position substantially axially lower than the datum position, said overshot means having a portion extending beneath the ramp means and abuttable agains the ramp means to limit the downwardly movement of the ramp means as the detent mounting member moves to its second position to a position that the ramp means and detent mounting member are relatively moved to the ramp means second position.

23. The apparatus of claim 22 further characterized in that said overshot assembly includes an overshot coupling rod attached to the overshot means to extend axially outwardly thereof and having a circumferential detent receiving groove axially outwardly of the overshot means, and that there is provided means for attaching a wire line cable to the overshot assembly, the last mentioned means including an overshot device having an axially inner end portion and means for couplingly engaging the overshot coupling rod and retaining the coupling engagement therewith until more than a determined force is exerted in a direction to move the overshot device axially away from the overshot means, the last mentioned coupling means being mounted on the overshot means inner end portion and comprising operable detent lock means for lockingly engaging said overshot rod portion, including a detent adapted for movement into the last mentioned groove, said lock means being operable to a rod release position, means for mounting the lock means on the overshot device for limited axial movement relative thereto between a datum position and a position axially inwardly of the last mentioned datum position, and resiliently retaining the lock means in the last mentioned datum position, and a fitting mounted on the overshot device to extend axially inwardly thereof for operating the lock means to its release position as the lock means moves relative the overshot device to the position axially inwardly of said last mentioned datum position, the means mounting the lock means having resilient characteristics that a substantially greater force is required for relatively moving the lock means to a position that the fitting operates the lock means to its release position than the force required to overcome the resilient action of the means for mounting the detent mounting means resisting the movement of the detent mounting means to its second position, and that there is provided means for attaching a wire cable to the overshot device axially remote from the lock means.

24. The apparatus of claim 22 further characterized in that the detent member mounting means includes a mount mounted by the overshot means in a fixed position relative thereto, an axially elongated spindle axially slidably extended through the mount, and resilient means acting against the spindle and mount for resiliently urging the spindle upwardly, said detent mounting member being mounted on the spindle below the mount.

25. The apparatus of claim 24 further characterized in that said detent mounting member includes means abutable against the mount to limit the upward movement of the spindle relative the mount, and that the ramp means second position relative the detent mounting member is axially outwardly of the ramp means first position.

26. For being moved through a drill stem, an axially elongated core barrel inner tube assembly and a first overshot assembly for moving the core barrel inner tube assembly through the drill stem, said core barrel inner tube assembly comprising means for receivingly retaining a core sample, a latch body, means for mounting the core sample retaining means on the latch body axially inwardly of the latch body, a latch mounted on the latch body for limited axial movement relative thereto between a drill stem latch seat engaging position and a retracted position, means for resiliently urging the latch to the latch seat engaging position, an axially elongated latch release tube mounted on the latch body for limited movement between an axial inner position permitting the latch moving to the latch seat engaging position and an axial outer position retracting the latch, a first overshot engagable coupling member mounted on the latch body and adapted for being couplingly engaged by the first overshot assembly for lowering the latch body through the drill stem, said first coupling member including an axially elongated rod fixedly attached to the latch body to extend axially outwardly thereof, said rod having an outer end portion that has a circumferential detent receiving groove, and a second coupling member mounted on the latch release tube and adapted for being couplingly engaged by a second overshot assembly for moving the latch release tube from the tube first position to the tube second position, said first coupling member being extended through the second coupling member and axially movable relative thereto, and being of an axial length to extend axially outwardly of the second coupling member in each of the latch release tubes positions, and the first overshot assembly for couplingly engaging the first coupling member including an overshot body having an axially inner end portion and coupling engaging means mounted on the overshot body inner end portion for couplingly engaging the first coupling member and retaining the coupling engagement therewith until more than a predetermined force is exerted thereto in a direction to move the overshot body axially away from the latch body, the coupling engaging means comprising operable detent lock means for lockingly engaging said rod portion, including a detent adapted for movement into said groove, said lock means being operable to a rod release position, means for mounting the lock means on the overshot body for limited axial movement relative thereto between a datum position and a position axially inwardly of the datum position, and resiliently retaining the lock means in the datum position, and a fitting mounted on the overshot body to extend axially inwardly thereof for operating the lock means to its release position as the lock means moves relative the overshot body to a position axially inwardly of the datum position.

27. For being moved through a drill stem, an axially elongated core barrel inner tube assembly, a first overshot assembly for moving the core barrel inner tube assembly through the drill stem, said core barrel inner tube assembly comprising means for receivingly retaining a core sample, a latch body, means for mounting the core sample retaining means on the latch body axially inwardly of the latch body, a latch mounted on the latch body for limited axial movement relative thereto between a drill stem latch seat engaging position and a retracted position, means for resiliently urging the latch to the latch seat engaging position, an axially elongated latch release tube mounted on the latch body for limited movement between an axial inner position permitting the latch moving to the latch seat engaging position and an axial outer position retracting the latch, a first overshot engagable coupling member mounted on the latch body and adapted for being couplingly engaged by the first overshot assembly for lowering the latch body through the drill stem, a second coupling member mounted on the latch release tube and adapted for being couplingly engaged by a second overshot assembly for moving the latch release tube from the tube first position to the tube second position, said first coupling member being extended through the second coupling member and axially movable relative thereto, and being of an axial length to extend axially outwardly of the second coupling member in each of the latch release tubes positions, and the first overshot assembly for couplingly engaging the first coupling member including an overshot body having an axially inner end portion, coupling engaging means mounted on the overshot body inner end portion for couplingly engaging the first coupling member and retaining the coupling engagement therewith until more than a predetermined force is exerted thereto in a direction to move the overshot body axially away from the latch body, and an overshot coupling rod attached to the overshot body to extend axially outwardly thereof, an overshot device, operable detent lock means for lockingly engaging said overshot rod, said lock means being operable to a rod release position, means for mounting the lock means on the overshot device for limited axial movement relative thereto between a datum position and a position axially inwardly of the last mentioned datum position, and resiliently retaining the lock means in the said last mentioned datum position, a fitting mounted on the overshot device to extend axially inwardly thereof for operating the lock means to its release position as the lock means moves relative the overshot device to a position axially inwardly of said last mentioned datum position, and means for attaching a wire line cable to the overshot device, said overshot device including a spindle, a lower jaw element fixedly secured to the spindle and an upper jaw element mounted on the spindle for limited slidable movement for applying a hammering blow to the lower jaw element.

28. For lowering a wire line core barrel inner tube assembly having an overshot coupling member through a drill stem, an axially elongated overshot body having an inner end portion and means for couplingly engaging the overshot coupling rod and retaining the coupling engagement therewith until more than a predetermined force is exerted in a direction to move the overshot body axially away from the overshot coupling rod, the last mentioned means being mounted on the overshot body inner end portion and including operable detent lock means for lockingly engaging said overshot rod, said lock means being operable to a rod release position, means for mounting the lock means on the overshot body for limited axial movement relative thereto between a datum position and a position axially inwardly of the datum position, and resiliently retaining the lock means in the datum position, and a fitting mounted on the overshot body to extend axially inwardly thereof for operating the lock means to its release position as the lock means moves relative the overshot body to a position axially inwardly of the datum position, and means for attaching a wire cable to the overshot device axially remote from the lock means.

* * * * *